US008136635B2

(12) United States Patent
Christy et al.

(10) Patent No.: US 8,136,635 B2
(45) Date of Patent: Mar. 20, 2012

(54) METHOD AND SYSTEM FOR MAINTAINING DISTANCE BETWEEN ELEVATOR CARS IN AN ELEVATOR SYSTEM WITH MULTIPLE CARS IN A SINGLE HOISTWAY

(75) Inventors: Theresa M. Christy, West Hartford, CT (US); Randall Keith Roberts, Hebron, CT (US); Harold Terry, Avon, CT (US); Mauro J. Atalla, South Glastonbury, CT (US); Arthur C. Hsu, South Glastonbury, CT (US); CheongSik Shin, Seoul (KR); Hansoo Shim, Seoul (KR)

(73) Assignee: Otis Elevator Company, Farmington, CT (US)

( * ) Notice: Subject to any disclaimer, the term of this patent is extended or adjusted under 35 U.S.C. 154(b) by 407 days.

(21) Appl. No.: 12/516,860

(22) PCT Filed: Dec. 22, 2006

(86) PCT No.: PCT/US2006/062542

§ 371 (c)(1),
(2), (4) Date: May 29, 2009

(87) PCT Pub. No.: WO2008/079147

PCT Pub. Date: Jul. 3, 2008

(65) Prior Publication Data

US 2010/0065378 A1 Mar. 18, 2010

(51) Int. Cl.
*B66B 9/00* (2006.01)

(52) U.S. Cl. ..... 187/249; 187/391; 187/314

(58) Field of Classification Search ..... 187/247, 187/249, 314, 316, 380–388, 391–393
See application file for complete search history.

(56) References Cited

U.S. PATENT DOCUMENTS

| | | | | |
|---|---|---|---|---|
| 849,840 | A | 4/1907 | Foster | |
| 974,439 | A | 11/1910 | Schwab | |
| 1,027,628 | A | 5/1912 | Schwab | |
| 1,805,227 | A | 5/1931 | Rugg | |
| 1,896,776 | A | 2/1933 | James | |
| 1,896,777 | A | 2/1933 | James | |
| 5,651,426 | A * | 7/1997 | Bittar et al. | 187/249 |

(Continued)

FOREIGN PATENT DOCUMENTS

EP 1371596 A1 12/2003

(Continued)

OTHER PUBLICATIONS

International Search Report and Written Opinion of the International Searching Authority for International applicatioin No. PCT/US2006/062542 mailed Oct. 24, 2007.

(Continued)

*Primary Examiner* — Anthony Salata
(74) *Attorney, Agent, or Firm* — Carlson, Gaskey & Olds PC

(57) ABSTRACT

Controlling the movement of elevator cars (22, 24) within a single hoistway (26) prevents the cars from becoming too close while servicing assigned stops. Example control techniques include controlling door operation of at least one of the elevator cars (22, 24) to effectively slow down a follower car or speed up a leader car for increasing a distance between the cars in an area within the hoistway (26) where the cars would otherwise be too close to each other.

20 Claims, 7 Drawing Sheets

U.S. PATENT DOCUMENTS

| | | | | |
|---|---|---|---|---|
| 5,663,538 | A | 9/1997 | Sakita | |
| 5,785,153 | A | 7/1998 | Powell et al. | |
| 5,823,299 | A * | 10/1998 | Wierschke et al. | 187/277 |
| 5,865,274 | A | 2/1999 | Kiji et al. | |
| 5,877,462 | A | 3/1999 | Chenais | |
| 6,273,217 | B1 | 8/2001 | Hikita | |
| 6,360,849 | B1 | 3/2002 | Hikita | |
| 6,364,065 | B1 | 4/2002 | Hikita | |
| 6,554,107 | B2 | 4/2003 | Yumura et al. | |
| 6,619,437 | B2 | 9/2003 | Hikita | |
| 7,032,716 | B2 | 4/2006 | Meyle et al. | |
| 7,117,979 | B2 | 10/2006 | Angst et al. | |
| 7,178,635 | B2 | 2/2007 | Meissner et al. | |
| 7,487,860 | B2 * | 2/2009 | Hikita et al. | 187/249 |
| 7,841,450 | B2 * | 11/2010 | Smith et al. | 187/249 |
| 2005/0082121 | A1 | 4/2005 | Deplazes | |
| 2005/0087402 | A1 | 4/2005 | Haegi et al. | |
| 2005/0279584 | A1 | 12/2005 | Reuter et al. | |
| 2006/0289240 | A1 | 12/2006 | Sakita | |
| 2007/0039785 | A1 | 2/2007 | Smith et al. | |
| 2007/0089935 | A1 * | 4/2007 | Hikita | 187/249 |

FOREIGN PATENT DOCUMENTS

| | | | |
|---|---|---|---|
| EP | 1698580 | A1 | 9/2006 |
| EP | 1785384 | A1 | 5/2007 |
| JP | 4345486 | | 12/1992 |
| JP | 4361960 | | 12/1992 |
| JP | 5051185 | | 3/1993 |
| JP | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004155519 | | 6/2004 |

OTHER PUBLICATIONS

International Preliminary Report on Patentability for International application No. PCT/US2006/062542 mailed Apr. 21, 2009.

* cited by examiner

METHOD AND SYSTEM FOR MAINTAINING DISTANCE BETWEEN ELEVATOR CARS IN AN ELEVATOR SYSTEM WITH MULTIPLE CARS IN A SINGLE HOISTWAY

FIELD OF THE INVENTION

This invention generally relates to elevator systems. More particularly, this invention relates to controlling movement of multiple cars in a single hoistway.

DESCRIPTION OF THE RELATED ART

Elevator systems typically include a car that moves within a hoistway to carry passengers or cargo between different levels in a building. It has been proposed to include more than one elevator car within a single hoistway to achieve various types of system efficiencies. One challenge facing designers of such systems is maintaining adequate separation between the elevator cars when they are independently moveable relative to each other. Various proposals have been made in this area.

U.S. Pat. No. 6,364,065 discloses an arrangement for assigning cars to a particular call based upon a probability that a car assignment would result in failing to maintain a desired separation between cars. U.S. Pat. No. 6,619,437 discloses an arrangement where a hoistway is divided into dedicated zones restricted to only one elevator car and a common zone where more than one elevator car may travel. A decision to enter the common zone is based upon a direction of movement of another elevator car in the common zone at that time.

Published U.S. Patent Application No. 2005/0082121 discloses an arrangement that uses information regarding car position and door locks for determining regions within a hoistway that allow an elevator car to move at a contract speed. In the event that an elevator car becomes too close to another, one or more brakes are applied.

One shortcoming of such proposals is that passengers may perceive what appears to be unusual elevator car operation, which may be annoying. For example, if an elevator car is moving at a normal speed and then brought to a stop or significantly slowed down before it reaches an intended destination, the passengers may think there is a problem with the elevator operation. Of course, the passengers are unaware of the proximity of another elevator car in the hoistway, which is the reason for the unusual slowdown or stop of the elevator.

Another shortcoming of previous arrangements is that they do not address the potential for introducing excessive noise and vibration when two cars travel too close to each other.

It is desirable to provide an arrangement and strategy for controlling the movement of multiple elevator cars in a hoistway to maintain desired separation while concealing special control measures from passengers to minimize passenger inconvenience and to avoid a perception that something wrong or unusual has occurred. It is also desirable to avoid unwanted noise and vibration. This invention addresses those needs.

SUMMARY OF THE INVENTION

An exemplary method of controlling an elevator system having a plurality of elevator cars in a single hoistway includes determining whether there is at least one area between the starting floors and the last destination floors assigned to the elevator cars where the elevator cars will be too close if the elevator cars operate at a normal, contract speed. A door operation of at least one of the elevator cars is controlled in a manner that changes a time when the at least one elevator car will travel in the at least one area to increase a distance between the elevator cars in the at least one area.

In one example, a motion profile of one of the elevator cars is altered such that an acceleration or speed of the elevator car is different than a normal, contract speed for at least a portion of the scheduled run.

In one example, a total amount of time desired to change the distance between the cars in the area where the cars would otherwise be too close is divided into smaller segments that are introduced at various portions along the scheduled run so that the total change in travel time for a corresponding elevator car achieves the desired change in distance between the elevator cars in the area where the cars would otherwise be too close.

An exemplary elevator system includes a hoistway and a plurality of cars in the hoistway. A controller is configured to determine when each of the elevator cars is assigned to travel from a starting floor to a last destination floor and there is at least one area between the starting floors and the last destination floors where the elevator cars will be too close if the elevator cars operate at a normal, contract speed. The controller controls a door operation of at least one of the elevator cars to change a time when the at least one elevator car will travel in the at least one area to increase the distance between the elevator cars in that area.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Disclosed examples provide the ability to strategically control multiple elevator cars within a single hoistway to avoid having the cars get too close to each other where the possibility of inadequate separation may exist or the proximity of the cars would introduce undesirable noise and vibration. Disclosed examples include various door control techniques that change the expected travel time of at least one of the elevator cars within at least one area where the cars would otherwise be too close to each other. Other example techniques can be combined with door control techniques to achieve a desired effect.

Figure 1:
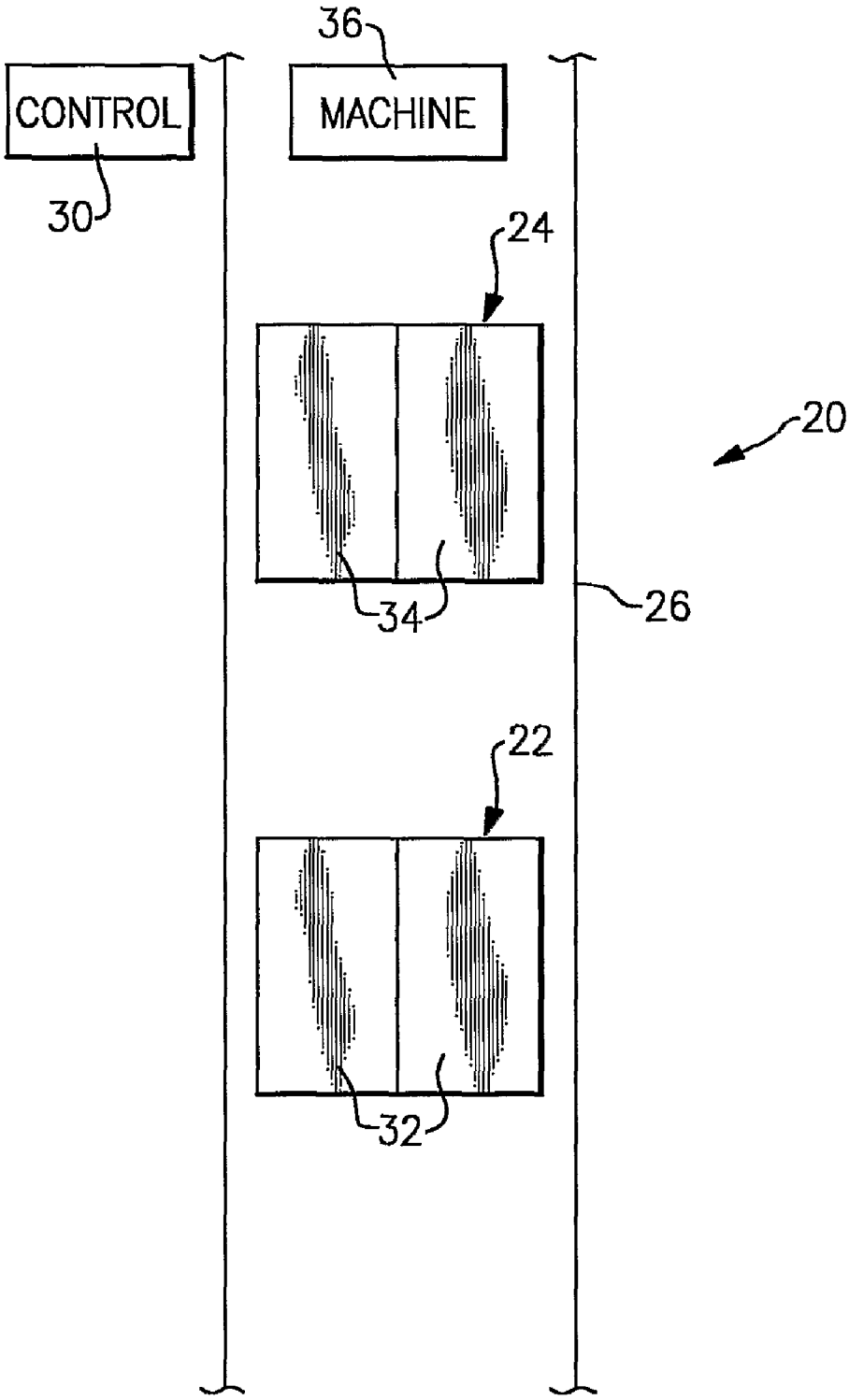
FIG. 1 schematically illustrates selected portions of an elevator system designed according to an embodiment of this invention.

FIG. 1 schematically shows selected portions of an elevator system 20 including elevator cars 22 and 24 within a single hoistway 26. A controller 30 controls the position and motion of the elevator cars 22 and 24 to maintain a desired distance between the elevator cars for purposes of separation assurance and for avoiding having the cars running too close to each other such that undesirable noise or vibration may be introduced to the system. One way in which the controller 30 achieves this in some examples includes controlling doors 32 of the elevator car 22 or doors 34 of the elevator car 24 in a manner that will modify the total travel time of the corresponding elevator car when servicing scheduled stops including a starting floor and a last destination floor.

A set of scheduled stops may include multiple scheduled stops or a single stop at the last destination floor. Various example sets of assigned stops are described with example control techniques below. Another technique used by the controller 30 is to control operation of one or more elevator machines 36 responsible for moving the elevator cars 22, 24 or both through the hoistway 26. By varying a speed or acceleration of at least one of the elevator cars from a normal, contract speed or acceleration for the given elevator system, the controller 30 can alter the timing when the elevator cars travel through various portions of the hoistway 26 while servicing their assigned stops.

Figure 2:
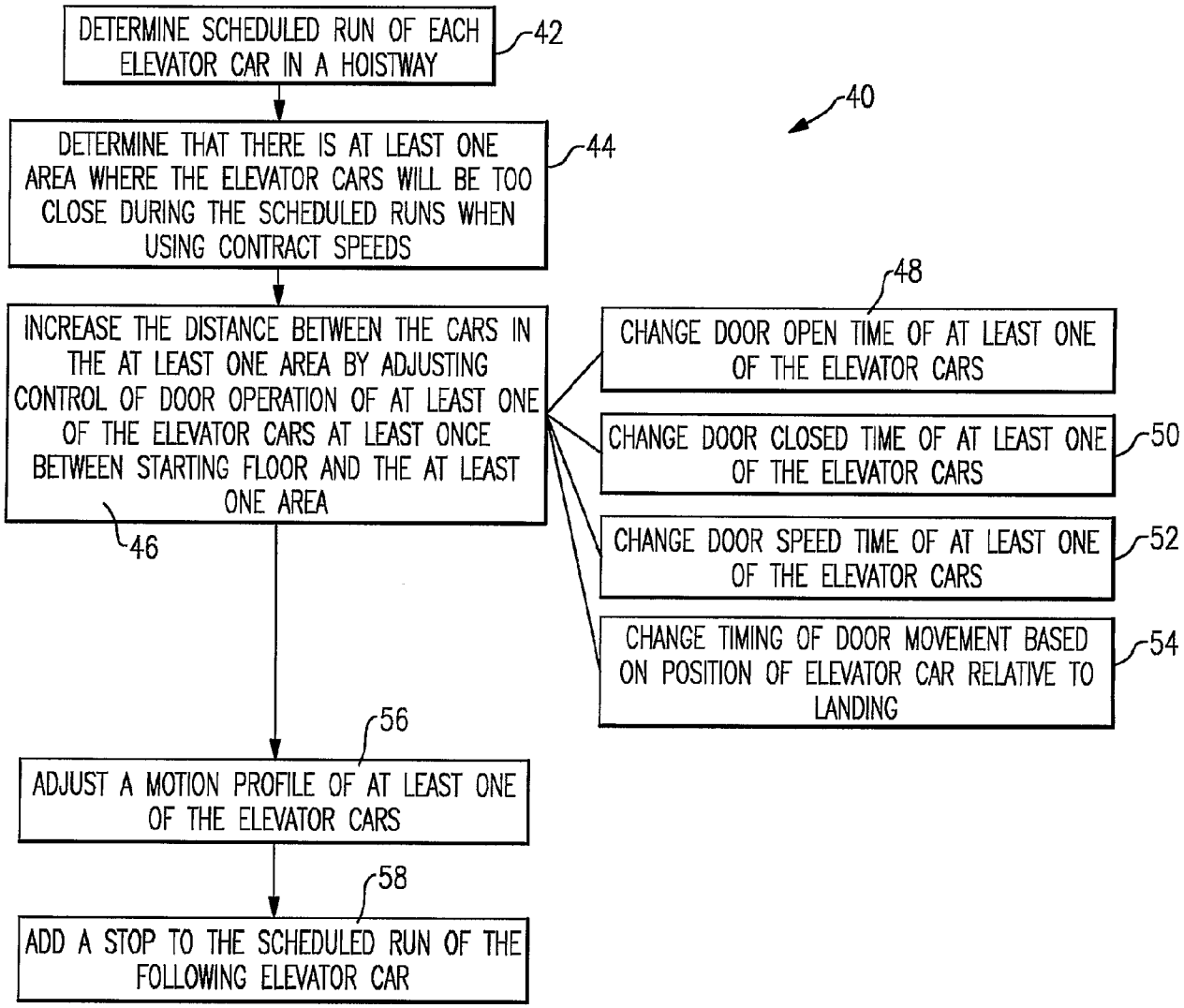
FIG. 2 is a flowchart diagram summarizing one example control strategy.

FIG. 2 includes a flowchart diagram 40 summarizing an example approach. At 42, the controller 30 determines a set of assigned stops for each elevator car 22, 24 in the hoistway 26. The example controller 30 is programmed to be able to determine whether there is at least one area along the hoistway in which the elevator cars 22, 24 will be too close to each other if both elevator cars travel at a normal, contract speed and acceleration rate. This determination is shown at 44 in FIG. 2.

One technique used in one example for increasing a distance between the elevator cars 22 and 24 in an area where they would otherwise be too close is to adjust control of door operation of at least one of the elevator cars at least once between a starting floor (including at the starting floor) and the area where the elevator cars 22, 24 are expected to be too close to each other. This is shown at 46 in FIG. 2. There are various door control techniques that are useful in this regard. One is shown at 48 in FIG. 2 and includes changing the door open time. When one of the cars should be delayed, the amount of time that elevator car's door is kept open at a scheduled stop or at the starting floor is increased. This effectively delays the time at which the elevator car will leave that stop, which in turn delays the time at which the elevator car will arrive at the area of concern.

If one of the elevator cars should be moved more quickly than if a normal, contract profile were followed, the door open time may be reduced so that the doors close sooner than they otherwise would at the starting floor or the scheduled stop. By closing the doors sooner than would otherwise be done, that elevator car is allowed to leave the starting floor or the selected stop sooner than would otherwise have occurred. This allows that car to arrive sooner at the area of concern than it would otherwise.

One example includes adjusting the door open time of one elevator car to increase the time that the door is kept open and to decrease the amount of time that the door is kept open on another elevator car in a manner that will increase the distance between the cars when at least one of them is in the area where the cars would otherwise be too close.

Another example technique is shown at 50 in FIG. 2. This example includes changing the time that the elevator door is kept closed. There are various time intervals that can be altered for keeping the door closed for a longer or shorter period of time, depending on the needs of a particular situation. For example, when it is desired to delay the departure of an elevator car from a scheduled stop or a starting floor, the amount of time that the doors are kept closed when arriving at that floor may be extended. Another example includes extending the time that the doors are kept closed prior to accelerating the car from the scheduled stop. Another example includes extending both of those door closed times.

When there is a desire to move an elevator car from one stop to another more quickly, the amount of time that the doors are kept closed upon arrival or prior to departure from a stop may be decreased in a suitable amount.

Another example technique is shown at 52 in FIG. 2. In this example, the speed with which the doors are moved is altered depending on the desired result. When more delay is desired, the elevator doors are moved more slowly than would normally occur. When less delay is desired, the elevator doors are moved more quickly than would otherwise occur. The maximum possible door speed typically will depend on an applicable code, the capacity of the door mover or both. By changing the time associated with door movement by even a few seconds in some examples will provide the additional distance between the elevator cars needed to avoid undesirable noise and vibration or a potential collision. Any one of or a combination of the example door control techniques may be used.

Another example technique is shown at 54. This technique uses the so-called landing open feature on a selective basis. The landing open feature includes timing the opening or closing of the door when the elevator car is within a prescribed distance of a landing and moving at a prescribed speed, which is different than only moving the elevator door when the elevator car is at a complete stop at a landing. When an early start from a scheduled stop is desired, for example, a landing open technique is applied to begin moving the car away from the landing before the doors are completely closed. On the other hand, when additional delay is desired, a landing open feature when an elevator car is approaching a landing may be omitted.

The example of FIG. 2 includes another technique at 56 for adjusting a motion profile of at least one of the elevator cars for achieving the desired distance between the cars in the area where they would otherwise be too close. A motion profile of an elevator car typically is set according to a contract speed and acceleration rate or a set of contract speeds and rates based upon the distance the car travels between scheduled stops. In this example, the speed or acceleration of the elevator car is dynamically adjusted to speed up a leading car or slow down a following car at some point between the starting floor and the area in which the cars would otherwise be too close.

The example of FIG. 2 includes another technique shown at 58 where an additional stop is added to a scheduled run independent of any passenger request for a stop at a corresponding floor. In other words, the technique at 58 includes adding a stop for a follower elevator car at a floor between the starting floor and the area where the elevator cars would otherwise be too close when that floor has not been selected as a destination and no hall call has been placed at that floor. Introducing an additional stop introduces additional time and effectively delays one of the elevator cars from arriving at the area where the cars would otherwise be too close.

Although the example of FIG. 2 includes the steps at 46, 56 and 58, not all of them need be implemented at any particular time. It is possible to use one or a combination of more than one of them in various control scenarios. Given this description, those skilled in the art will realize which portions of what disclosed examples or variations of them will best suit their particular needs.

One example includes considering the traffic condition of the elevator system when deciding which control technique to implement. For example, during high traffic conditions, it may be more advantageous to speed up a leading car in the hoistway compared to delaying a following car in the hoistway. Introducing additional delays during high traffic conditions, for example, may decrease the traffic capacity of the elevator system. In such a situation, it would be more desirable to move a leading car more quickly to provide additional distance between the leading car and a following car. On the other hand, during low traffic conditions, it may be more desirable to enhance passenger convenience by providing additional delay of a following car, which will effectively slow down the arrival time of the following car at various locations in the hoistway and provide the desired additional distance between the cars. The controller 30 in one example is programmed to determine the elevator system traffic condition using known techniques and to select an appropriate control for providing the desired amount of distance between the elevator cars within the hoistway.

Figure 3:
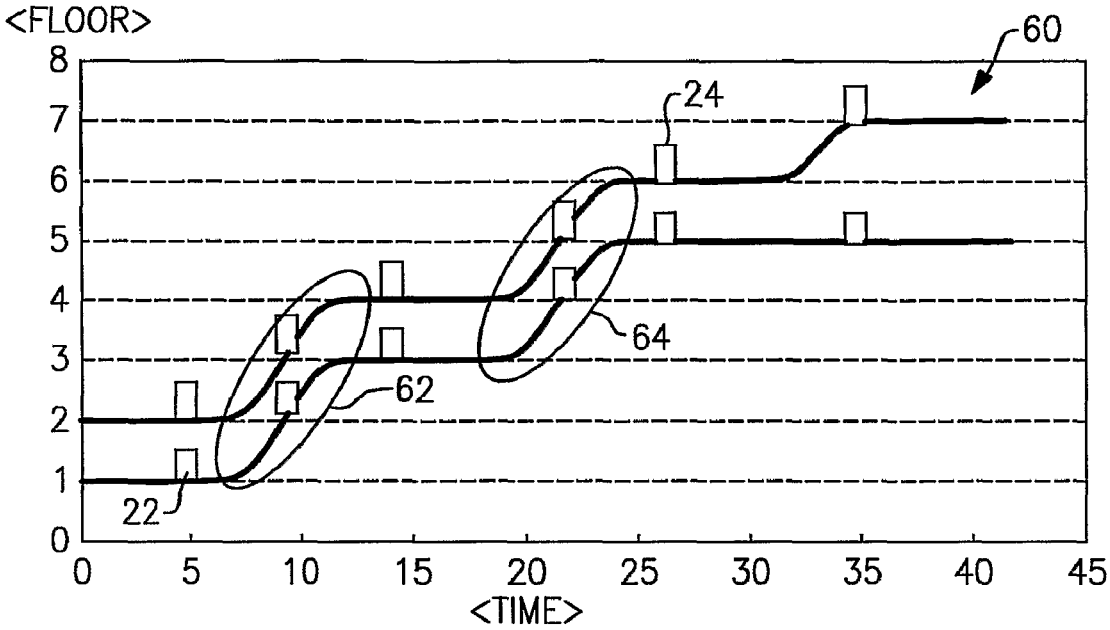
FIG. 3 schematically illustrates the timing of two elevator car positions within a hoistway for an example set of assigned stops.

FIG. 3 includes a plot 60 that schematically illustrates the timing of various positions of the elevator cars 24 and 22 at various times when the cars 22 and 24 service a set of scheduled stops using a normal, contract motion profile. The elevator car 24 is above the elevator car 22 and can be considered a leading car when the cars are traveling in an upward direction. The lower car 22 can be considered a follower car under such situations. Similarly, when both cars are traveling downward, the elevator car 22 is the leading car and the elevator car 24 is the follower car.

As shown in FIG. 3, there are two areas 62 and 64 in which the cars are traveling too close to each other so that undesirable noise, vibration or both may be introduced during system operation. It is desirable, therefore, to introduce additional spacing between the elevator cars in at least the areas 62 and 64 by implementing one of the example control techniques. In this example, the cars are moving upward and the traffic conditions are such that it is more desirable to extend the total travel time of the elevator car 22 (e.g., delay the follower car).

Figure 4:
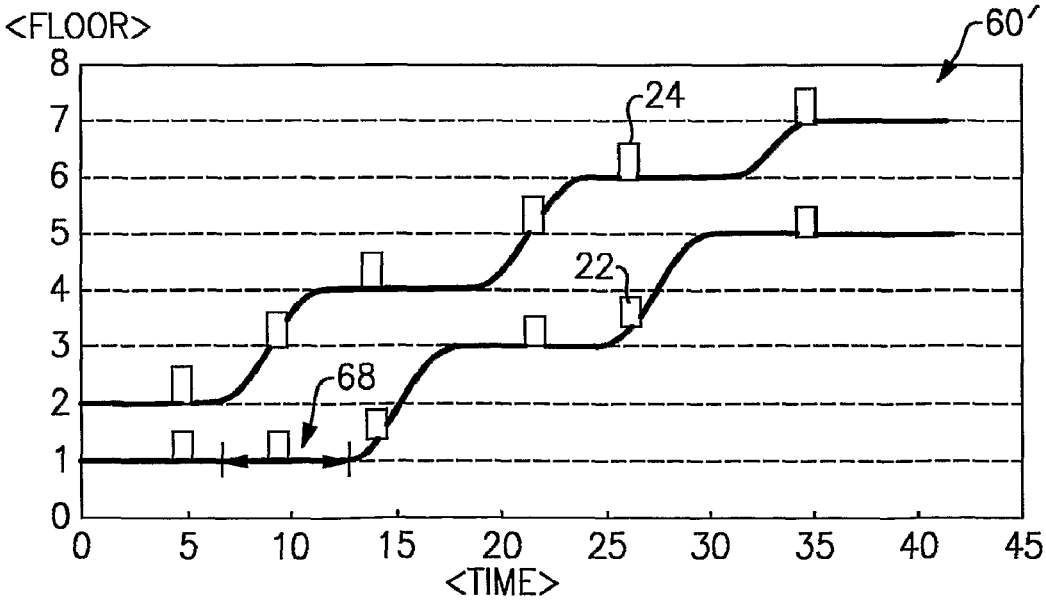
FIG. 4 schematically illustrates the timing of the position of the elevator cars from the example of FIG. 3 when a control strategy designed according to an embodiment of this invention is implemented.

FIG. 4 shows one example technique for avoiding the scenario shown in FIG. 3. The plot 60' and the associated relative elevator car positions are modified compared to the plot 60. In this example, the amount of time that the elevator car 22 remains at the starting floor (e.g., level 1 in the drawing) is extended as shown at 68. One or more of the techniques mentioned above can be used for this purpose. For example, the amount of time that the doors remain open, closed or both may be extended. The speed with which the elevator car door moves may be reduced and the time associated with accelerating the car from the stop may be extended. By effectively delaying the departure of the car 22 from the starting floor for about five seconds, the area 62 and the area 64 no longer become a problem as can be appreciated in FIG. 4. In this example, a spacing of two floors between the cars is sufficient for most operating conditions. Other examples include other minimum desired spacings. Additionally, the desired minimum spacing may vary depending on whether both of the cars are moving.

In some circumstances the total time desired for either delaying one car or speeding up the other car may be long enough that if it is implemented in one instance while servicing the scheduled stops, it may be noticeable or inconvenient for passengers. In the example of FIG. 4, an approximately five second additional delay at the starting floor will likely be acceptable and unnoticed by most passengers. Under some circumstances, it will be more advantageous to divide up the total time required to achieve the desired change in distance between the cars into a plurality of smaller time segments.

Figure 5:
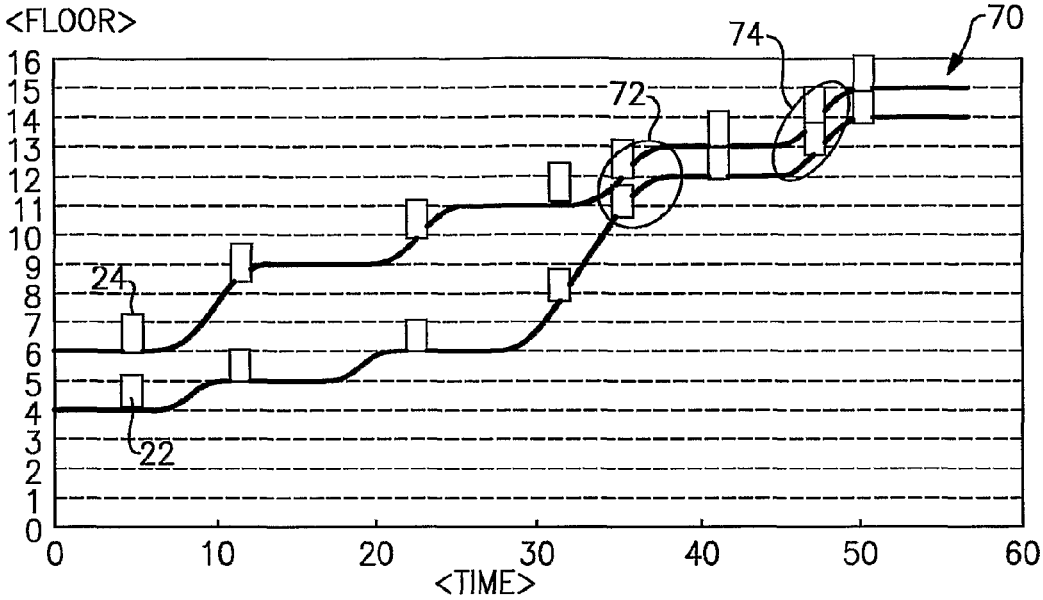
FIG. 5 schematically illustrates the timing of two elevator car positions within a hoistway for another example set of assigned stops.

FIG. 5 shows a plot 70 illustrating the position and timing of the elevator cars 22 and 24 while servicing another set of scheduled stops using contract motion profiles. This example includes two areas 72 and 74 during which both elevator cars are moving and are too close to each other.

Figure 6:
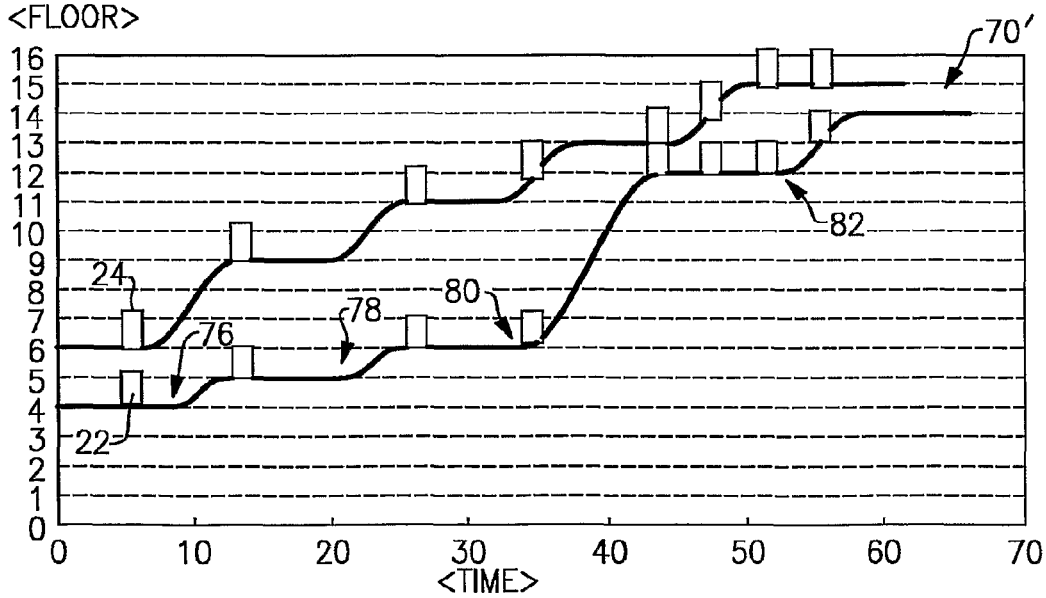
FIG. 6 schematically illustrates the timing of the position of the elevator cars from the example of FIG. 5 when a control strategy designed according to an embodiment of this invention is implemented.

FIG. 6 shows an altered plot 70' for the cars 22 and 24. In this example, multiple delays 76, 78, 80 and 82, which each comprise a smaller segment of a total desired delay, are introduced at various portions along the total travel of the car 22. By distributing the desired delay in this manner, an even more seamless and unnoticeable change may be introduced to elevator car operation such that passengers will not know the difference between when such a control technique is introduced, and normal, contract operation. In this example, the same technique, such as slowing door movement, is used at each delay segment. In another example, various techniques are used to accumulate a total desired delay. Any one of the example delay techniques from this description may be used alone or in combination with at least one other technique.

Figure 7:
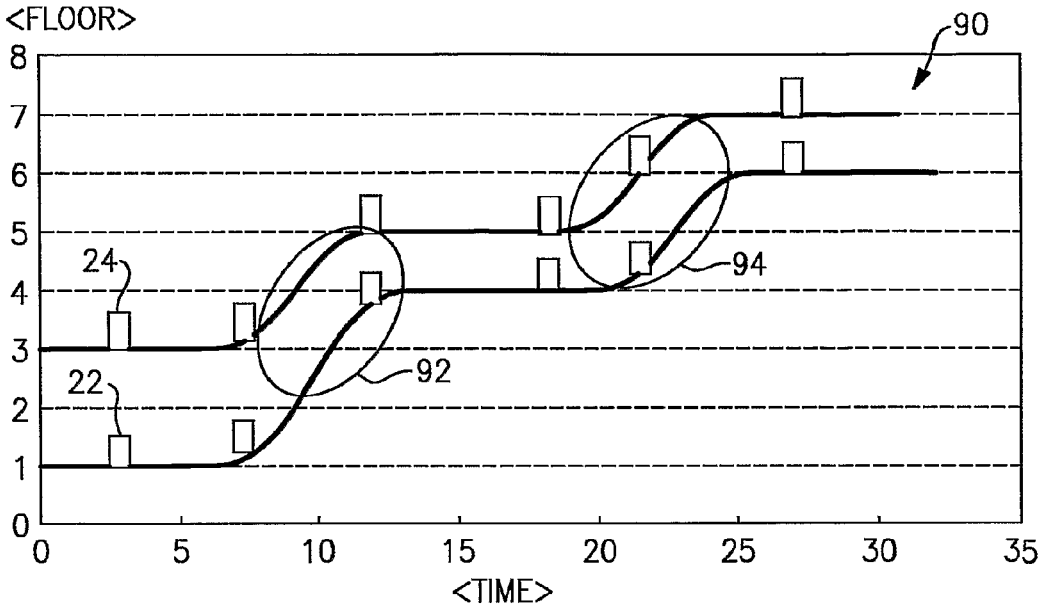
FIG. 7 schematically illustrates the timing of two elevator car positions within a hoistway for another example set of assigned stops.
Figure 8:
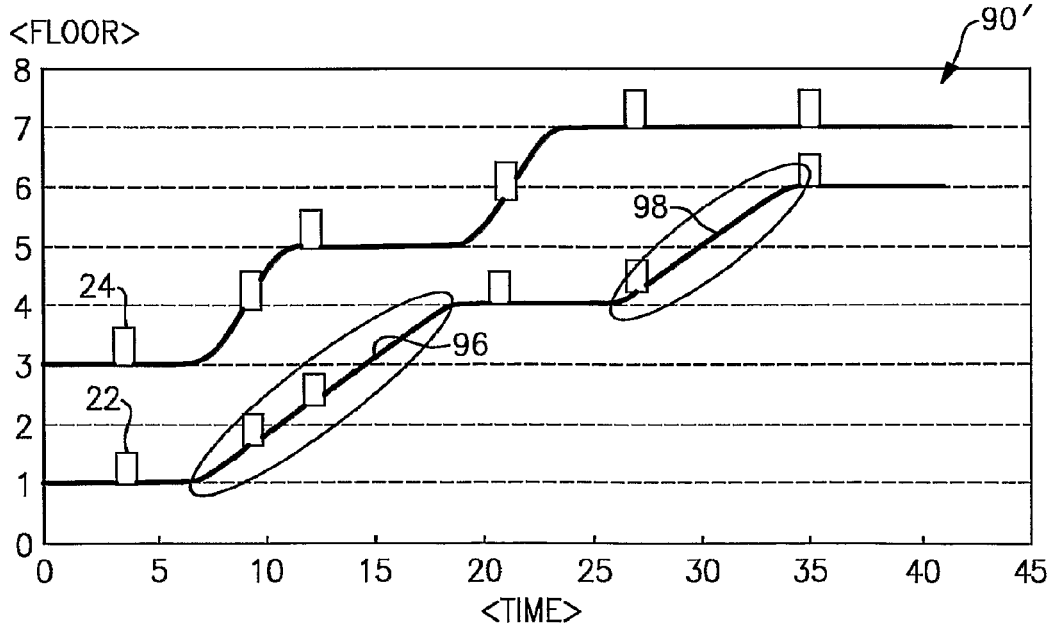
FIG. 8 schematically illustrates the timing of the position of the elevator cars from the example of FIG. 7 when a control strategy designed according to an embodiment of this invention is implemented.

FIG. 7 includes a plot 90 that includes two areas 92 and 94 where the cars 22 and 24 will be too close to each other such that vibration or noise could be an issue. FIG. 8 includes a plot 90' where the travel of the car 22 has been modified by adjusting the motion profile for the car 22. In two areas at 96 and 98, the speed with which the car 22 moves has been reduced compared to that shown in FIG. 7, which corresponds to the normal, contract speed. By reducing the speed in this manner, adequate spacing is maintained between the cars at all times shown in FIG. 8.

It is also possible to increase the speed with which the car 24 moves although there are more limitations on increasing elevator car speed beyond contract speeds compared to the ability to decrease the speed relative to a contract speed.

One example includes determining when the leading car is empty and then moving the leading car at a highest possible speed within the mechanical limits of the system to increase the distance between the cars.

Figure 9:
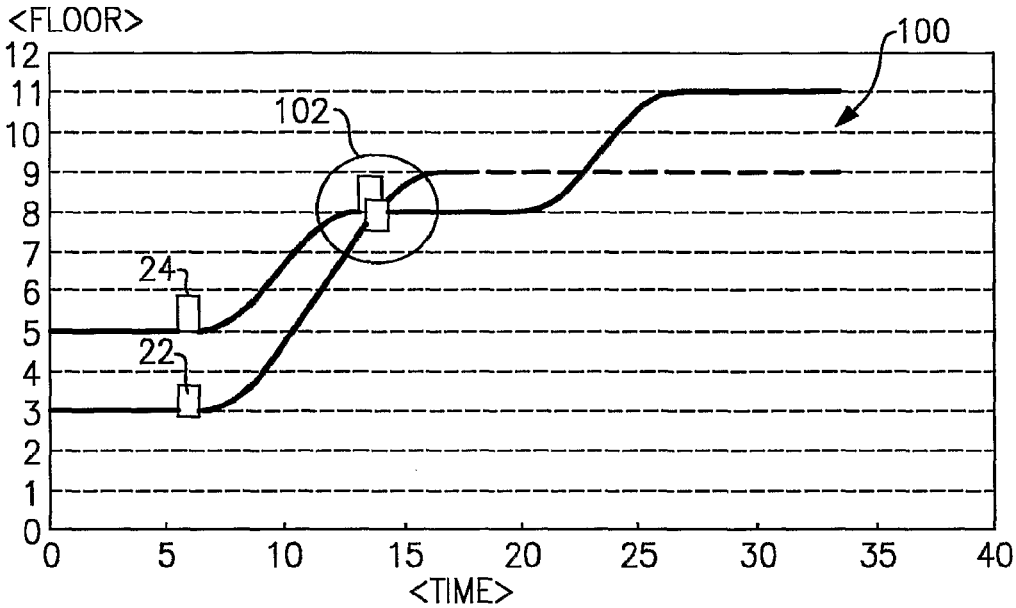
FIG. 9 schematically illustrates the timing of two elevator car positions within a hoistway for another example set of assigned stops.

FIG. 9 includes a plot 100. In this example, inadequate separation would occur at 102 when the car 24 is parked on floor 8 and the car 22 is assigned to travel up to floor 9 at the same time.

Figure 10:
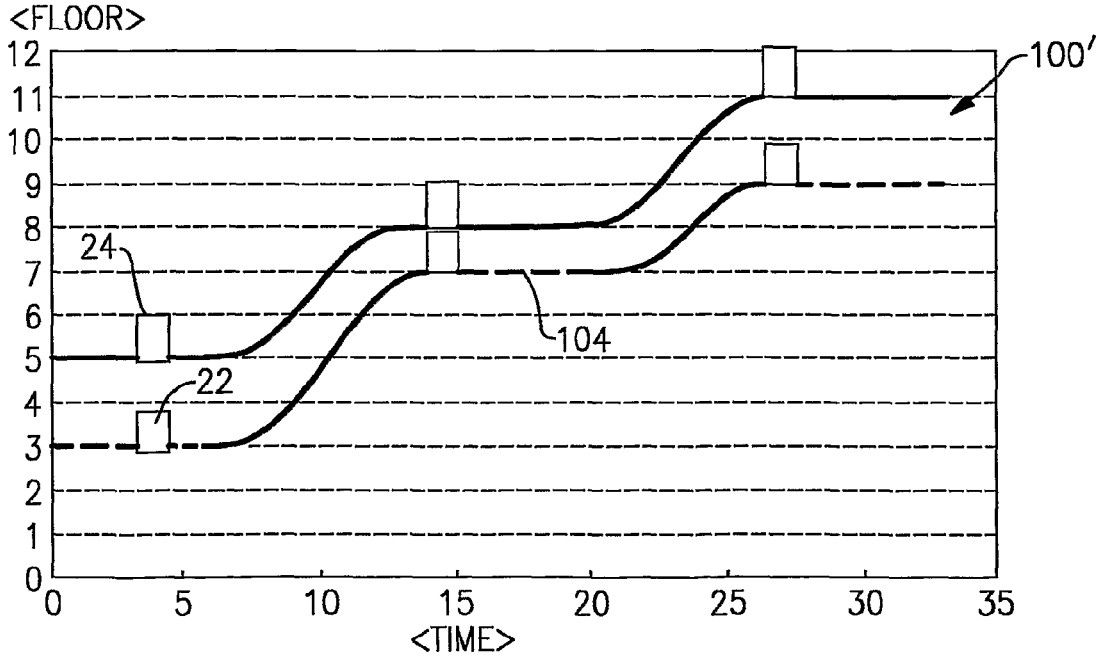
FIG. 10 schematically illustrates the timing of the position of the elevator cars from the example of FIG. 9 when a control strategy designed according to an embodiment of this invention is implemented.

FIG. 10 includes a plot 100' showing one example technique for avoiding the situation in FIG. 9. In this example, an additional stop is added for the car 22. As shown at 104, the car 22 stops at floor 7 while the car 24 is parked at floor 8. The stop at floor 7 for the car 22 was not required by a passenger indicating floor 7 as a desired destination. Similarly, no hall call is placed at floor 7. Instead, the controller 30 automatically caused the car 22 to stop at the floor 7 and, in one example, opened and closed the doors as if it were a scheduled stop so that passengers on board the car 22 would not be alarmed by the car stopping and then starting again. After sufficient time has passed, the elevator car 22 is allowed to proceed up to floor 9.

Figure 11:
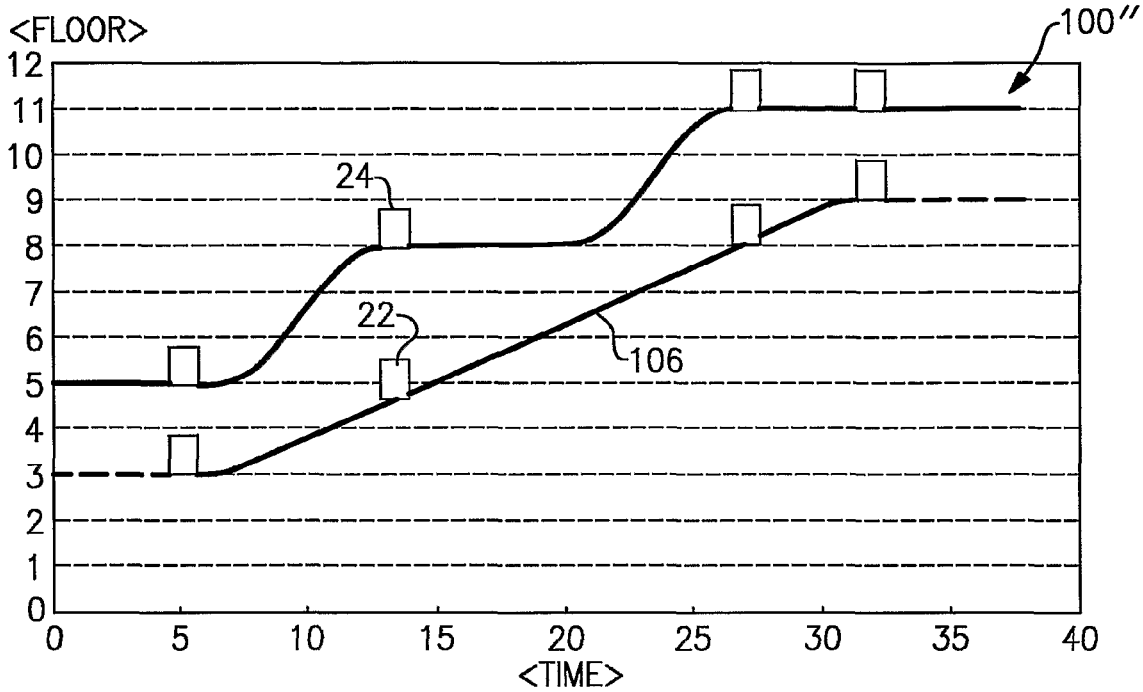
FIG. 11 schematically shows the timing of the position of the elevator cars of the example of FIG. 9 when another example control strategy designed according to an embodiment of this invention is implemented.

FIG. 11 includes a plot 100" that shows another technique for addressing the situation schematically shown in FIG. 9 that includes altering the motion profile of the elevator car 22. In this example, the speed with which the elevator car 22 moves has been reduced compared to the contract speed as shown at 106. In this example, no additional stop is required and enough time passes by the time the elevator car reaches floor 8 so that the car 24 is out of the way and there is no risk of a collision.

Figure 12:
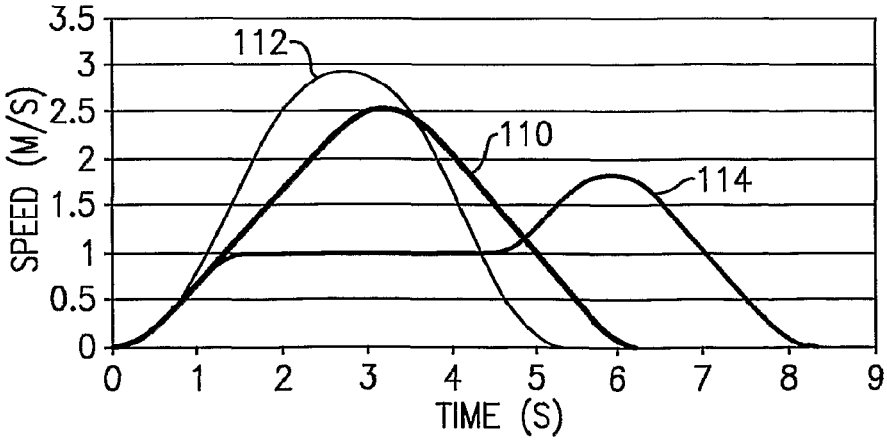
FIG. 12 schematically illustrates an example motion profile modification technique useful in an embodiment of this invention.

Altering the motion profile in one example includes using one of a variety of techniques. FIG. 12 schematically shows a contract motion profile 110 for an elevator run covering eight meters. In this example, the maximum jerk is 1.6 $m/s^3$ and the maximum acceleration is 1.0 $m/s^2$. This example run takes 6.32 seconds. A modified motion profile is shown at 112 where the maximum jerk and maximum allowable speed (e.g., more than 3 m/s) are not exceeded but the acceleration reaches a rate of 2.17 $m/s^2$. This type of motion profile is mechanically possible although it may be excessive for passenger comfort. The motion profile shown at 112 may be useful, for example, for moving an empty car when it is desirable to move that car as quickly as possible. In this example, the motion profile 112 results in reducing the total time by approximately one second. Another example motion profile is shown at 114 where the car does not accelerate to its full speed at first but later speeds up. In this example, five seconds into the run, the car has moved about half the distance (e.g., 4.24 m). This motion profile adds about two seconds to the run time but may be useful for situations where a following car is heading toward another car because the additional run time allows the other car to move for maintaining a desired distance between the cars.

Selecting the motion profile in one example is based upon a current traffic condition. For example, during heavy traffic conditions, motion profiles corresponding to shorter runs may be most useful. On the other hand, when traffic intensity is light, reducing energy and providing improved ride quality and comfort may be achieved by selecting a motion profile where the run time is longer. One advantage of modifying a motion profile in this regard is to avoid having a car travel at the contract acceleration rate or speed and then having to stop during the run to wait for another car to be moved out of the way. Smoothing out the change from a contract motion profile provides improved perception of performance because passengers are typically more satisfied when they know that their car is moving toward their destination rather than waiting for no apparent reason. For example, it is most likely better for the car to move slowly to a next stop rather than waiting for sometime and then moving quickly or moving quickly and then stopping to wait for another car to move out of the way before continuing. Additional benefits to using an adjusted motion profile includes energy savings when it is possible to move a car slower because traffic is light enough and improving handling capacity and dispatching performance by moving a car faster when it is possible because the car is empty, for example.

A variety of control techniques have been disclosed above. Various combinations of them may be implemented in a system designed according to an embodiment of this invention. Given this description, those skilled in the art will realize which individual technique or which combination will best meet the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system having a plurality of elevator cars in a single hoistway that are each assigned to travel from a respective starting floor to a respective last destination floor, comprising the steps of:

determining whether there is at least one area between the starting floors and the last destination floors assigned to the elevator cars where the elevator cars will be too close if the elevator cars operate at a normal, contract speed; and controlling a door operation of at least one of the elevator cars to change a time when the at least one elevator car will travel in the at least one area to increase a distance between the elevator cars in the at least one area.

2. The method of claim 1, comprising at least one of controlling the door operation of a following one of the elevator cars for extending a time the following car remains at a scheduled stop before the following car reaches the at least one area; or controlling the door operation of a leading one of the elevator cars for decreasing a time the leading car remains at a scheduled stop before the leading car reaches the at least one area.

3. The method of claim 2, comprising extending the dwell time of the following car by at least one of slowing door movement when the following car is at the scheduled stop;

holding a door open for an extended time at the scheduled stop;

increasing a time between door closure and accelerating the following car from the scheduled stop; or increasing a time between stopping the following car at the scheduled stop and opening the door.

4. The method of claim 2, comprising decreasing the dwell time of the leading car by at least one of increasing a speed of door movement when the leading car is at the scheduled stop;

decreasing an amount of time the door is held open when the leading car is at the scheduled stop;

decreasing a time between door closure and accelerating the leading car from the scheduled stop;

decreasing a time between stopping the leading car at the scheduled stop and opening the door; or beginning to open the door of the leading car before the leading car completely stops at the scheduled stop.

5. The method of claim 1, comprising determining a desired amount of time needed to increase the distance between the elevator cars in the at least one area;

dividing the desired amount of time into a plurality of shorter time segments; and changing an amount of time the at least one of the elevator cars is at least two of a plurality of scheduled stops based on the shorter time segments before the at least one of the elevator cars reaches the at least one area.

6. The method of claim 1, comprising adjusting a motion profile of at least one of the elevator cars to move at a speed or acceleration that is different than a normal, contract speed or acceleration.

7. The method of claim 6, comprising at least one of decreasing at least one of the speed or acceleration of a following one of the elevator cars at least once between the starting floor and the last destination floor for the following car; and increasing at least one of the speed or acceleration of a leading one of the elevator cars at least once between the starting floor and the last destination floor for the leading car.

8. The method of claim 7, comprising determining that the leading car is empty; and moving the empty leading car as fast as possible along at least some of the distance between the corresponding starting floor and the last destination floor.

9. The method of claim 1, comprising determining a traffic condition of the elevator system;

increasing a total travel time for a following one of the elevator cars between the corresponding starting floor and last destination floor when there is a first traffic condition; and decreasing a total travel time for a leading one of the elevator cars between the corresponding starting floor and last destination floor when there is a second, different traffic condition.

10. The method of claim 1, comprising adding at least one stop between the starting floor and the at least one area for a following one of the elevator cars independent of a passenger request for the at least one stop.

11. An elevator system, comprising:

plurality of elevator cars in a hoistway, each elevator car having at least one door; and a controller configured to determine when each of the elevator cars is assigned to travel from a respective starting floor to a respective last destination floor and there is at least one area between the starting floors and the last destination floors where the elevator cars will be too close if the elevator cars operate at a normal, contract speed, and to responsively control a door operation of at least one of the elevator cars to change a time when the at least one elevator car will travel in the at least one area to increase a distance between the elevator cars in the at least one area.

12. The system of claim 11, wherein the controller is configured to control the door operation of a following one of the elevator cars for extending a dwell time of the following car at a scheduled stop for the following car before the following car reaches the at least one area; or control the door operation of a leading one of the elevator cars for decreasing a dwell time of the leading car at a scheduled stop for the leading car before the leading car reaches the at least one area.

13. The system of claim 12, wherein the controller is configured to extend the dwell time of the following car by at least one of slowing door movement when the following car is at the scheduled stop;

holding a door open for an extended time at the scheduled stop;

increasing a time between door closure and accelerating the following car from the scheduled stop; or increasing a time between stopping the following car at the scheduled stop and opening the door.

14. The system of claim 12, wherein the controller is configured to decrease the dwell time of the leading car by at least one of increasing a speed of door movement when the leading car is at the scheduled stop;

decreasing an amount of time the door is held open when the leading car is at the scheduled stop;

decreasing a time between door closure and accelerating the leading car from the scheduled stop;

decreasing a time between stopping the leading car at the scheduled stop and opening the door; or beginning to open the door of the leading car before the leading car completely stops at the scheduled stop.

15. The system of claim 11, wherein the controller is configured to determine a desired amount of time needed to increase the distance between the elevator cars in the at least one area;

divide the desired amount of time into a plurality of shorter time segments; and change an amount of time the at least one of the elevator cars is at least two of a plurality of scheduled stops based on the shorter time segments before the at least one of the elevator cars reaches the at least one area to change an amount of time the at least one elevator car is at the plurality of scheduled stops.

16. The system of claim 11, wherein the controller is configured to adjust a motion profile of at least one of the elevator cars to move at a speed or acceleration that is different than a normal, contract speed or acceleration.

17. The system of claim 16, wherein the controller is configured to decrease at least one of the speed or acceleration of a following one of the elevator cars at least once between the starting floor and the last destination floor for the following car; or increase at least one of the speed or acceleration of a leading one of the elevator cars at least once between the starting floor and the last destination floor for the leading car.

18. The system of claim 17, wherein the controller is configured to determine that the leading car is empty; and control movement of the empty leading car to move as fast as possible along at least some of the distance between the corresponding starting floor and the last destination floor.

19. The system of claim 11, wherein the controller is configured to determine a traffic condition of the elevator system;

increase a total travel time for a following one of the elevator cars between the corresponding starting floor and last destination floor when there is a first traffic condition; and decrease a total travel time for a leading one of the elevator cars between the corresponding starting floor and last destination floor when there is a second, different traffic condition.

20. The system of claim 11, wherein the controller is configured to add at least one stop between the starting floor and the at least one area for a following one of the elevator cars independent of a passenger request for the at least one stop.

* * * * *

UNITED STATES PATENT AND TRADEMARK OFFICE

CERTIFICATE OF CORRECTION

PATENT NO. : 8,136,635 B2
APPLICATION NO. : 12/516860
DATED : March 20, 2012
INVENTOR(S) : Christy et al.

It is certified that error appears in the above-identified patent and that said Letters Patent is hereby corrected as shown below:

ON THE TITLE PAGE:

Inventor Arthur C. Hsu's information should read as follows:

--Arthur Hsu, South Glastonbury, CT (US)--

Signed and Sealed this
Twenty-seventh Day of October, 2015

Michelle K. Lee

Michelle K. Lee
*Director of the United States Patent and Trademark Office*